US006817753B2

(12) United States Patent
Buenger et al.

(10) Patent No.: US 6,817,753 B2
(45) Date of Patent: Nov. 16, 2004

(54) PACKAGING SYSTEM FOR COSMETIC FORMULATIONS

(75) Inventors: Joachim Buenger, Gross-Umstadt Heubach (DE); Hansjürgen Driller, Gross-Umstadt (DE); Jutta Zur Lange, Darmstadt (DE); Annette Wagner, Frankfurt (DE)

(73) Assignee: Merck Patent Gesellschaft MIT Beschraenkter Haftung, Darmstadt (DE)

( * ) Notice: Subject to any disclaimer, the term of this patent is extended or adjusted under 35 U.S.C. 154(b) by 0 days.

(21) Appl. No.: 10/152,993

(22) Filed: May 23, 2002

(65) Prior Publication Data

US 2003/0048693 A1 Mar. 13, 2003

Related U.S. Application Data

(63) Continuation of application No. 09/936,562, filed as application No. PCT/EP00/01976 on Mar. 7, 2000, now abandoned.

(30) Foreign Application Priority Data

Mar. 17, 1999 (DE) ..... 199 11 776

(51) Int. Cl.[7] ..... B01F 3/08; B01F 5/06; B01F 15/02; B67D 5/06

(52) U.S. Cl. ..... 366/336; 366/341; 222/145.5

(58) Field of Search ..... 366/336, 341, 366/DIG. 1, DIG. 2, DIG. 3, DIG. 4, 162.1; 222/145.5

(56) References Cited

U.S. PATENT DOCUMENTS

| | | | | |
|---|---|---|---|---|
| 3,608,782 A | | 9/1971 | Sathico | |
| 5,520,460 A | | 5/1996 | Lantz | |
| 5,848,732 A | | 12/1998 | Brugger | |
| 5,904,424 A | | 5/1999 | Schwesinger et al. | |
| 6,155,710 A | * | 12/2000 | Nakajima et al. | 366/176.1 |
| 6,170,981 B1 | * | 1/2001 | Regnier et al. | 366/336 |
| 6,177,479 B1 | * | 1/2001 | Nakajima et al. | 366/176.1 |
| 6,190,034 B1 | * | 2/2001 | Nielsen et al. | 366/336 |
| 6,241,379 B1 | * | 6/2001 | Larsen | 366/181.5 |
| 6,258,858 B1 | * | 7/2001 | Nakajima et al. | 366/DIG. 3 |
| 6,281,254 B1 | * | 8/2001 | Nakajima et al. | 366/DIG. 3 |

FOREIGN PATENT DOCUMENTS

| | | | |
|---|---|---|---|
| EP | 0 319 638 A | | 6/1989 |
| FR | 2 669 243 A | | 5/1992 |
| WO | WO 96 30113 A | | 10/1996 |
| WO | WO 9728894 | * | 8/1997 |
| WO | WO97/30783 | * | 8/1997 |

* cited by examiner

*Primary Examiner*—Tony G. Soohoo
(74) *Attorney, Agent, or Firm*—Millen White Zelano & Branigan, P.C.

(57) ABSTRACT

The invention relates to a packaging system for the in-situ preparation of cosmetic formulations which has a micromixer. This micromixer can be connected to one or more stock chambers.

18 Claims, 1 Drawing Sheet

PACKAGING SYSTEM FOR COSMETIC FORMULATIONS

The invention relates to a packaging system for the in-situ preparation of cosmetic formulations which has a micromixer. This micromixer may be connected to one or more stock chambers.

Cosmetic formulations are frequently prepared using simple stirred vessels with various types of stirrer. Depending on the stirrer type (for example anchor, propeller, inclined-blade, disc or EKATO multistage impulse countercurrent stirrers or EKATO Mizer disc), different shear forces occur in the stirred vessels. Temperature distribution and also the energy input into the formulation are affected by the stirrer. the shear forces, temperature and introduced energy are not uniformly distributed in the batch vessel and thus affect the build-up of the resultant formulation.

Cosmetic formulations are usually commercially available in the form of packaged creams, emulsions, lotions and gels. In this connection, the shelf life and the stability of the formulations represents a problem. For this reason, the products contain a wide variety of additives, which may result in irritation or allergic reactions in the case of very sensitive users. In various cases, stability reasons also mean that it may not be the actual active ingredients that are employed in the formulations, but instead suitable derivatives have to be used which only decompose at the site of action. The latter is associated firstly with a time delay and with the effect or liberation of a further compound. Both together may significantly reduce the effectiveness of the actual active ingredients.

In order to circumvent these problems, various systems have been developed in which formulations are stored separately in different vessels or stock chambers. The separate formulations are not mixed until directly before use, either by combining the formulations from the different stock chambers and mixing them with one another by shaking or stirring. In some cases, the formulations have to be manually mixed with one another in advance. Another possibility is to combine the separate formulations from the stock vessels via channels or thin tubes in an output aperture by means of a pump system connected to one another.

These systems all have the disadvantage that only restricted mixing of the initially introduced formulations is possible and the formation of high-quality emulsions is not possible by mixing taking place in this way, in particular of microemulsions, unless an initially introduced emulsion is only mixed with an active ingredient-containing formulation.

The object of the present invention is therefore to provide a packaging system by means of which high-quality creams, emulsions, lotions, gels or other cosmetic formulations can be prepared in situ in a simple manner by the user. A further object of the invention is to provide a packaging system by means of which the use of various additives, such as emulsifiers, surfactants, preservatives and the like, which can act as irritants or cause allergic reactions for sensitive persons, can be reduced or entirely avoided.

The object is achieved by a packaging system for the in-situ preparation of cosmetic formulations which has a micromixer.

The present invention therefore relates to a packaging system of this type which has one, in particular two or more, stock chambers, each of which is provided with a thin tube, each of which terminates in a channel of a micromixer, in which mixing of the flowable components present from the various stock chambers can take place.

The various stock chambers advantageously have a common pump system. The stock chambers may be under pressure.

The stock chambers may, for the purposes of use, be connectable to the pump system, which is connected to a micromixer and has a dispensing aperture for the mixed product.

The present invention also relates to a corresponding packaging system which has two or more stock chambers connected externally to one another.

In accordance with the invention, a constituent of the packaging system is a micromixer consisting of two or more thin sheet-like structures which are connected permanently to one another and which have repeatedly crossing channels in at least one of the surfaces facing one another.

This micromixer can be made of metal, silicon or plastic structures.

In a particular embodiment, the packaging system may be designed in such a way that the pump system, which is connected to a micromixer and has an dispensing aperture for the mixed product, is re-usable.

The present invention relates to a packaging system for the in-situ preparation of cosmetic formulations in the form of lotions, emulsions, gels or creams or of liposome-containing or active ingredient-containing formulations.

For certain formulations, uniform mixing, temperature and energy input, even at the micro-level, is important. A micromixer enables preparation under uniform temperature conditions at the micro-level. In contrast to a large-volume stirred reactor, the energy input is the same in the very small volumes for all contents. Furthermore, microemulsions can be prepared better via the multiple shear conditions of the communicating channels than in a stirred vessel. The micromixer is suitable for the preparation of very fine and homogeneous formulations.

It has now been found that the use of micromixers enables the in-situ preparation of mixtures in the form of emulsions, suspensions and dispersions, lotions, solutions, gels and creams in which all contents are uniformly distributed, even in extremely small volume parts.

It is possible to prepare these mixtures under uniform temperature conditions at the micro-level, since as good as no temperature gradient forms in the thin, optionally laminate-like channels owing to the small volumes if the separately introduced formulations are warmed. Furthermore, the input of energy is the same in each volume part, i.e. even in the smallest. It has also been found that emulsions having a significantly more homogeneous droplet size distribution can be prepared than in a stirred vessel. Owing to the multiple shear conditions of the communicating channels in the micromixer, droplet sizes in the micro-range are inevitably specified, so that microemulsions are obtained, which could only be prepared in a very complex manner in a stirred vessel. The use of a micromixer is therefore suitable for the preparation of very fine homogeneous formulations. This is advantageously possible in situ.

Suitable for the packaging system according to the invention are micromixers and associated connection and sealing systems which are described in the patent applications DE 1 95 11 603, DE 1 97 46 583, DE 1 97 46 584, DE 19746585 and DE 1 98 54 096, and modifications thereof that are evident to the person skilled in the art. Suitable micromixers and associated connection and sealing systems may consist of suitable metallic, ceramic or polymeric materials or of silicon. They can be mechanically connected or adhesively bonded. The connection to the other parts of the packaging system according to the invention is preferably effected mechanically. It goes without saying here that pressurised parts are undetachably connected to sealing parts. This means that the present invention includes both packaging systems whose stock chambers are under pressure and are provided with withdrawal valves and unpressurised packaging systems from which the formulations are withdrawn with the aid of pump systems.

Problematic formulations in the W/O area are emulsions, in particular those having high contents of vegetable triglycerides. Emulsions without stabilising waxes are frequently distinguished by inadequate long-term viscosity constancy, and O/W lotions are generally more difficult to stabilise than creams. These emulsions can therefore be prepared particularly well using micromixers. It is of particular advantage here than the use of micromixers enables particularly small amounts to be prepared, which can advantageously be prepared in situ, i.e. directly before use.

Microemulsions are thermodynamically stable if, owing to extremely low interfacial energy, they are formed spontaneously, i.e. without the supply of external mechanical energy. The droplet diameters are significantly smaller than in the case of microemulsions; they are in the range 10–30 nm (nanometers), i.e. below the wavelength of visible light. Microemulsions are therefore colloidally disperse, optically transparent systems. According to POHLER, certain concentration ranges of the oil and water phases and of the emulsifiers and auxiliaries must be observed for the formulation of microemulsions:

| | |
|---|---|
| Surfactants (usually nonionic surfactants) | 15–40% |
| Mineral oil or vegetable oil | 5–25% |
| Polyalcohols | 0–20% |
| Water | 35–65% |

The use of micromixers for the preparation of microemulsions enables the use of surfactants to be considerably reduced, enabling the toleration for particularly sensitive skin types to be significantly increased. Stable microemulsions can be prepared using as little as less than 10% by weight of surfactants. In certain formulations, surfactants can also be omitted completely, if desired.

The most important requirements of emulsification equipment are usually adequate and in particular variable emulsification power, sufficient shear or impact forces, fitting-out for uniform treatment of the batch, vacuum device, heating and cooling (14). These problems can be solved in a simple manner in accordance with the invention through the use of suitable micromixers, which ensure specific input of energy in each volume element and in which intensive mixing takes place in the thin channels with exposure to intensive shear forces.

The use of micromixers furthermore enables very small amounts of the desired cosmetic or pharmaceutical formulations to be prepared immediately before use. This has the advantage that the addition of emulsifiers, suspension aids and dispersion aids in the form of surfactants and other additives, such as, for example, stabilisers, can be greatly restricted or their use can be omitted entirely. It is also possible in this way for active ingredients or additives which are incompatible with one another in a formulation over an extended period not to be mixed with one another until directly before use.

Active ingredients which are only stable in a formulation in the form of a derivative can be initially introduced as such in a separate formulation and not added to the remaining mixture until directly before use. This also enables the user to add various additives, as desired, to small amounts of a base mixture at various points in time. This may be of interest both for pharmaceutical and for cosmetic formulations if different active ingredients are to be applied at different points in time.

Different additives can be added to a cosmetic base formulation for the day than for the night. Additives for the day may be, for example, UV filters, while those for the night may be regenerating additives.

For better understanding and for illustration, examples are given below which fall within the scope of protection of the present invention, but are not suitable for restricting the invention to these examples.

BRIEF DESCRIPTION OF THE DRAWINGS

FIG. 1 shows by way of example an embodiment of a packaging system according to the invention which has two different stock chambers A and A', from which liquid formulations or formulations which have been liquefied by warming can be withdrawn by means of a common pump system B. The pump system B is connected to a micromixer C via thin lines b, which may consist of thin plastic tubes; to be precise, the lines b are permanently connected to the micromixer at their ends remote from the pump system and terminate in the thin channels c of the micromixer. The repeatedly crossing or partially overlapping channels c run into an outlet aperture d or, in a particular embodiment, into a dispensing tube. Details of the pump system according to the invention are familiar to the person skilled in the art.

Figure 1:
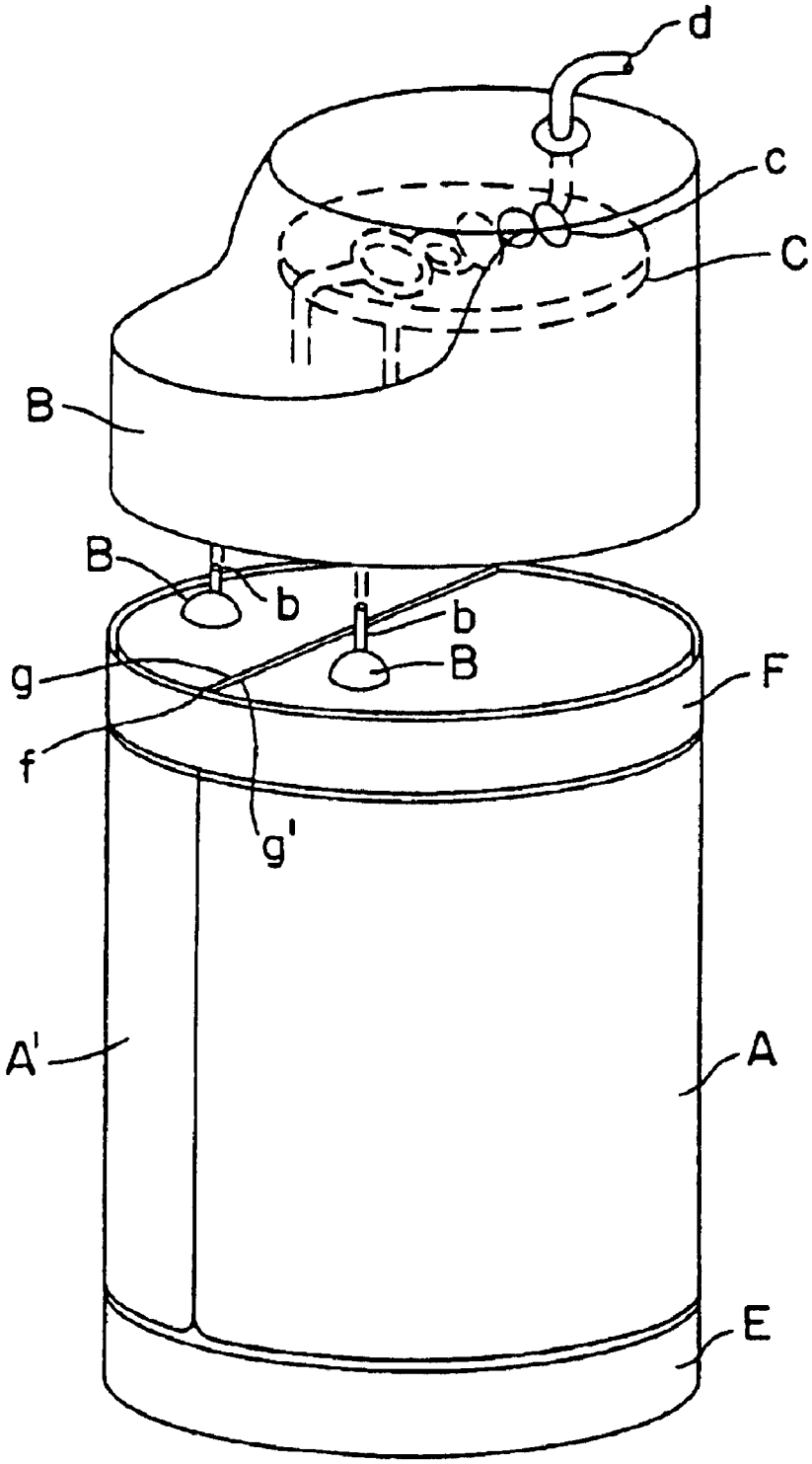
FIG. 1 is a perspective view of an exemplary packaging system of the present invention.

The designs of the micromixer employed may correspond to those described in the patent applications indicated above. However, they may also be micromixers which have been modified in applicational terms. The micromixers are preferably permanently connected to the pump system. They may, as shown in FIG. 1, be integrated into a type of lid, which is either freely movable or tiltable at the point at which the pump system is actuated. This point may correspond be located in a lower plane than the discharge aperture.

The stock vessels connected to one another in the packaging system shown may be inserted in a detachable manner in the holder E and held together at the upper edge by means of an attachable ring F, so that the stock vessels are repeatedly connected to one another in the same position and the pump system can be repeatedly placed onto the connecting tubes b with an accurate fit. In order to achieve this, it is appropriate to provide the upper ring with a nose f, with which the stock vessels must be in contact on the right and left by means of the surface edges g and g' facing one another. The lid having the pump system and the micromixer is, if desired, placed on the ring F.

EXAMPLE 1

| W/0 body-care milk (COLD PREPARATION) | |
|---|---|
| A. ARLACEL 780 | 5.0% |
| Paraffin oil, low-viscosity | 10.0% |
| Miglyol 812 | 4.0% |
| ARLAMOL HD | 50% |
| ARLAMOL E | 1.0% |
| Perfume (if desired) | q.s. |
| B. Glycerin | 2.5% |
| ATLAS G-2330 | 1.5% |
| Mg $SO_4$ | 0.5% |
| Demin. water | 70.5% |
| Preservative (if desired) | q.s. |

Preparation Method

The two phases A and B are each introduced separately into a stock container which are provided with a common pump system connected to a micromixer. For use, the phases are pumped out of the stock containers and passed jointly through the micromixer, in which the phases are mixed intensively. A homogeneously mixed milk is obtained which can be used directly.

Viscosity 10 000 mPas (Brookfield LVT Helipath, spindle C, 6 rpm, 1 min.)

Procurement Sources (1) ICI Surfactants

EXAMPLE 2

| Sun-protection milk (W/S) (water in silicone) | | |
|---|---|---|
| A Eusolex 2292 (Art. No. 5382) | (1) | 2.00 |
| DC 1401 | (2) | 10.00 |
| DC 3225 C | (2) | 10.00 |
| Dow Corning 344 | (2) | 10.00 |
| q.s. | | |
| B Eusolex 232 (Art. No. 5372) | (1) | 2.00 |
| Tris(hydroxymethyl)-aminomethane (Art. No. 8386) | (1) | 0.88 |
| Sodium chloride (Art. No. 6400) | (1) | 2.00 |
| Glycerin (Art.-Nr. 4093) | (1) | 5.00 |
| Preservative (if desired.) | | q.s. |
| Water, demineralised | | to 100.00 |

Preparation

In order to prepare the sun-protection milk, the two phases, which have been initially introduced into separate stock chambers, are, for mixing, pumped jointly with the aid of a pump system through a micromixer connected via thin connecting tubes.

Notes

Viscosity 22,800 mPas (Brookfield RVT, spindle C, 10 rpm) at 25° C. Samples contain the following as preservatives: 0.05% of propyl 4-hydroxybenzoate (Merck Art. No. 7427) 0.17% of methyl 4-hydroxybenzoate, sodium salt (Merck Art. No.6756)

Procurement Sources (1) E. Merck, Darmstadt (2) Dow Corning, Düsseldorf

EXAMPLE 3

| Transparent microemulsion | | |
|---|---|---|
| Trade name | INCI | % by weight |
| Eumulgin B2 | Ceteareth-20 | 19.5 |
| Cetiol RE | PEG-7 Glyceryl Cocoate | 20.0 |
| Uniphen P-23 | Phenoxyethanol + Methyl-/Ethyl-/Propyl-/Butylparaben | 0.3 |
| Mineral oil | Mineral Oil | 5.0 |
| Glycerin | Glycerin | 20.0 |
| Water, demin.. | Water | 35.2 |

Preparation

1. Eumulgin B2, Cetiol HE, Uniphen P-23 and the paraffin oil are introduces into a stock vessel and heated to about 95° C.–105° C. for melting before use.
2. Water and the glycerin are combined in a second stock vessel and likewise heated to about 95° C.–100° C.
3. The water phase and the fat phase are pumped through a micromixer for intensive mixing. The resultant micro-emulsion gel is stirred for cooling.

EXAMPLE 4

| Sun-protection gel (emulsifier-free) SPF 3.21 UVA PF 2.5 (sun protection factor, Diffey Method) | | |
|---|---|---|
| | | % by weight |
| A Eusolex 2292 (Art. No. 105382) | (1) | 1.000 |
| Luvitol EHO | (2) | 9.000 |
| Dow Corning 200 (100 cs) | (3) | 2.000 |
| Antaron V-220 | (4) | 2.000 |
| Jojoba oil | (5) | 5.000 |
| DL-α-Tocopherol acetate (Art. No. 500952) | (1) | 0.500 |
| B Tris(hydroxymethyl)aminomethane (Art. No. 108386) | (1) | 0.700 |
| Water, demineralised | | 14.300 |
| Water, demineralised | | to 100.000 |
| D Aloe Vera Gel 1:10 | (7) | 1.000 |

Preparation

For phase C, homogeneously disperse the Pemulen TR-1. in water, add preservative and pre-swell. Phase B is introduced into phase C with homogenisation and initially introduced in a stock vessel. Dissolve phase A with heating. Add phase D at 35° C. and initially introduce in a second stock vessel. For use, stock chamber A/D is warmed to about 35° C., and the contents together with the contents of stock chamber B/C are passed, by means of a pump system, through a micromixer connected to the pump system and homogenised.

Notes

Viscosity 67,000. mPas (Brookfield RVT, spindle C, 5. rpm) at 25° C. $PH_{25° C.}$=6.9

As preservative, 1.0% of phenoxyethanol (Merck Art. No. 807291) may optionally be added.

| Procurement sources | |
|---|---|
| (1) Merck KGaA, Darmstadt | (2) BASF, Ludwigshafen |
| (3) Dow Corning, Düsseldorf | (4) GAF, Frechen |
| (5) Henry Lamotte, Bremen | (6) Goodrich, Neuss |
| (7) Rahn, Maintal | |

What is claimed is:

1. A packaging system for the in-situ preparation of cosmetic formulations, comprising a micromixer, wherein the micromixer comprises two or more thin sheet-like structures which are permanently connected to one another and which have repeatingly crossing channels in at least one of the surfaces facing one another having dimensions effective for intensive mixing within the micromixer, and two or more stock chambers, each having a thin tube, wherein each tube terminates in a channel of a micromixer, wherein mixing of the flowable components present from the different stock chambers can take place.

2. A packaging system according to claim 1, wherein the different stock chambers have a common pump system.

3. A packaging system according to claim 2, wherein the pump system, which is connected to the micromixer and has a dispensing aperture for the mixed product, is re-usable.

4. A packaging system according to claim 1, a wherein the stock chambers are under pressure.

5. A packaging system according to claim 1, wherein the stock chambers are individually connectable to a pump system, which is connected to the micromixer and has a dispensing aperture for a mixed product.

6. A packaging system according to claim 1, wherein the two or more stock chambers are connected externally to one another.

7. A packaging system according to claim 1, wherein the micromixer is made from metal, silicon or plastic structures.

8. A packaging system according to claim 1 for the in-situ preparation of cosmetic formulations in the form of lotions, emulsions, gels or creams.

9. A packaging system according to claim 1 for the in-situ preparation of liposome-containing formulations.

10. A packaging system according to claim 1 for the in-situ preparation of active ingredient-containing formulations.

11. A packaging system according to claim 1, further comprising a dispensing aperture for providing a mixed product immediately and directly to a user.

12. A package system according to claim 1, wherein a first stock chamber contains a first liquid comprising oil and a second stock.

13. A packaging system according to claim 12, wherein a resulting mixture is a microemulsion.

14. A packaging system for the in-situ preparation of cosmetic formulations comprising, a micromixer comprising two or more thin sheet-like structures which are permanently connected to one another and which have repeatingly crossing channels in at least one of the surfaces facing one another; and two or more stock chambers, each having a thin tube terminating in one of said channels; wherein intensive mixing of flowable components within said stock chambers occurs when said components flow from said stock chambers through said tubes into and through said channels.

15. A packaging system for the in-situ preparation of cosmetic formulations, comprising a micromixer, wherein the micromixer comprises two or more thin sheet-like structure which are permanently connected to one another and which have repeatingly crossing channels in at least one of the surfaces facing one another having dimensions effective for intensive mixing within the micromixer, and two or more stock chambers which are connected externally to one another.

16. A method of preparing cosmetic formulations in-situ, comprising mixing liquids intensively with a packaging system according to claim 15.

17. A method of preparing cosmetic formulations in situ, comprising mixing liquids intensively with a packaging system according to claim 14.

18. A method of preparing cosmetic formulations in-situ, comprising mixing liquids intensively with a packaging system according to claim 1.

* * * * *

UNITED STATES PATENT AND TRADEMARK OFFICE

CERTIFICATE OF CORRECTION

PATENT NO. : 6,817,753 B2 
DATED : November 16, 2004
INVENTOR(S) : Joachim Buenger et al.

It is certified that error appears in the above-identified patent and that said Letters Patent is hereby corrected as shown below:

Column 8,
Line 10, reads "second stock." should read -- second stock chamber contains a second liquid comprising water. --.

Signed and Sealed this

Twenty-seventh Day of September, 2005

JON W. DUDAS
*Director of the United States Patent and Trademark Office*